US005700207A

United States Patent [19]

Guthrie et al.

[11] Patent Number: 5,700,207

[45] Date of Patent: Dec. 23, 1997

[54] GOLF PUTTER WITH COUNTERBALANCED PUTTER HEAD

[76] Inventors: Dale Guthrie, #602, 12831-66 St., Edmonton, Alberta, Canada, T5C 0A4; Tom Bennett, 17204-91 St., Edmonton, Alberta, Canada, T5Z 2M9

[21] Appl. No.: 675,057

[22] Filed: Jul. 3, 1996

[51] Int. Cl.[6] ..... A63B 53/04

[52] U.S. Cl. ..... 473/313; 473/314; 473/341

[58] Field of Search ..... 473/340, 379, 473/313, 314, 341

[56] References Cited

U.S. PATENT DOCUMENTS 3,042,405 7/1962 Solheim ..... 473/313

FOREIGN PATENT DOCUMENTS 727051 3/1955 United Kingdom ..... 273/169

OTHER PUBLICATIONS

Golf Digest Jul. 1972 p. 83 Golfsonic Middle Bottom Advirtisement.

*Primary Examiner*—Sebastiano Passaniti
*Assistant Examiner*—Stephen Blau
*Attorney, Agent, or Firm*—Terry M. Gernstein

[57] ABSTRACT

A golf putter having a counterbalanced head is provided. The head originates from a section of railway track and comprises a rectangular striking surface. A counterbalancing section is formed at the rear of the putter head and is interconnected to the front of the head by means of a web. An elongate shaft is mounted on said web at substantially the centre of gravity of the putter head.

6 Claims, 4 Drawing Sheets

GOLF PUTTER WITH COUNTERBALANCED PUTTER HEAD

FIELD OF THE INVENTION

The present invention relates to a golf putter. More specifically, the golf putter is provided with a uniquely configured putter head.

BACKGROUND OF THE INVENTION

The golf putter head of this invention originated from a desire to provide railway personnel with a unique golf putter commemorative of their service in the industry. It was found, somewhat surprisingly, after a few modifications, that a section of railway track would provide not only a decorative putter head but one exhibiting improvments in terms of actual utility.

A search of the prior art was conducted, the most pertinent patents located being those detailed herebelow. U.S. Pat. No. 3,567,227 issued to A. T. Panks disclosed a golf putter having two triangularly opposed shaped hitting faces. The putter head is substantially symmetrical relative to a plane passing along the centre line of the shaft.

T. Morris in U.S. Pat. No. Des. 306,055 illustrates a pendulum putter comprising a generally cylindrical head, the striking faces being defined by the ends of said cylinder. The shaft is positioned generally centrally about said cylinder.

In designing a putter head one seeks to increase the striking surface or range thereof with concomitant diminution of the dead areas which are those external of the striking surface.

SUMMARY OF THE INVENTION

In accordance with the present invention there is provided a golf putter counterbalanced about the base of the putter shaft which comprises:

a putter head, said putter head defining a substantially rectangular striking surface and forming a counterbalancing section at the rear of said putter head, said head and rear section being interconnected by a web to thereby form an integral putter head; and an elongate shaft mounted on a said web at substantially the centre of gravity of said putter head.

Advantageously, by providing this particularly configured putter head the percentage of putting surface has been increased as has the effective striking range. Furthermore, because of the placement of the shaft at the centre of gravity of the putter head it is possible to obtain a better flow and smoother swing. Additionally, because the dead areas are equal in size and weight no resultant imbalance of the putter head takes place.

DESCRIPTION OF THE DRAWINGS

The product of the invention will now be described having reference to the accompanying figures in which.

DESCRIPTION OF THE PREFERRED EMBODIMENT

Figure 1:
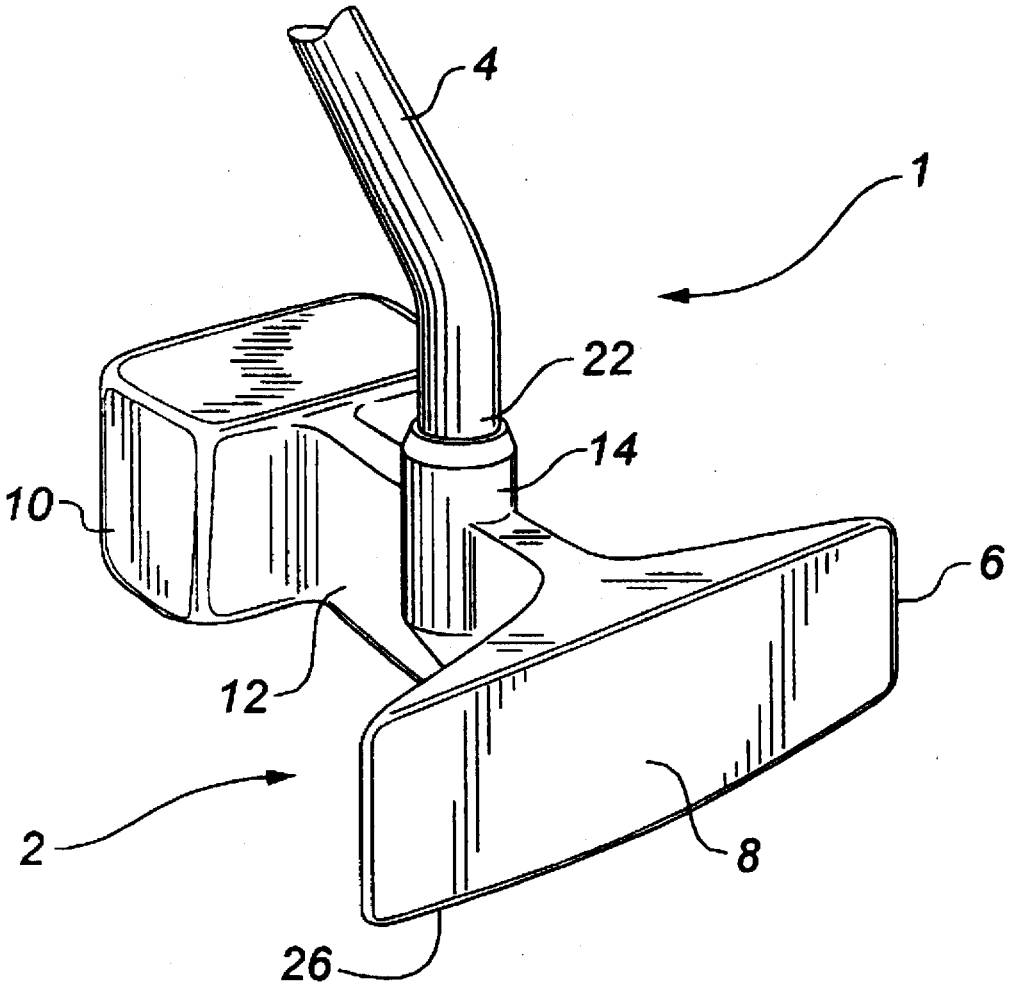
FIG. 1 is a perspective view of the putter head of the invention.

Having reference to the accompanying drawings, there is shown a golf putter 1 having a putter head 2 and a shaft 4. (Only the lower portion of the shaft 4 is shown in these drawings, the remainder of the shaft 4 being of conventional design).

The putter head 2 defines a forward section 6, having the striking face 8 at its forward and a rearward counterbalancing section 10. The forward section 6 and rearward section 10 are interconnected by a web 12.

The base of the shaft 4 is mounted into the web 12 and is generally positioned at the centre of gravity of the putter head 2.

Figure 2:
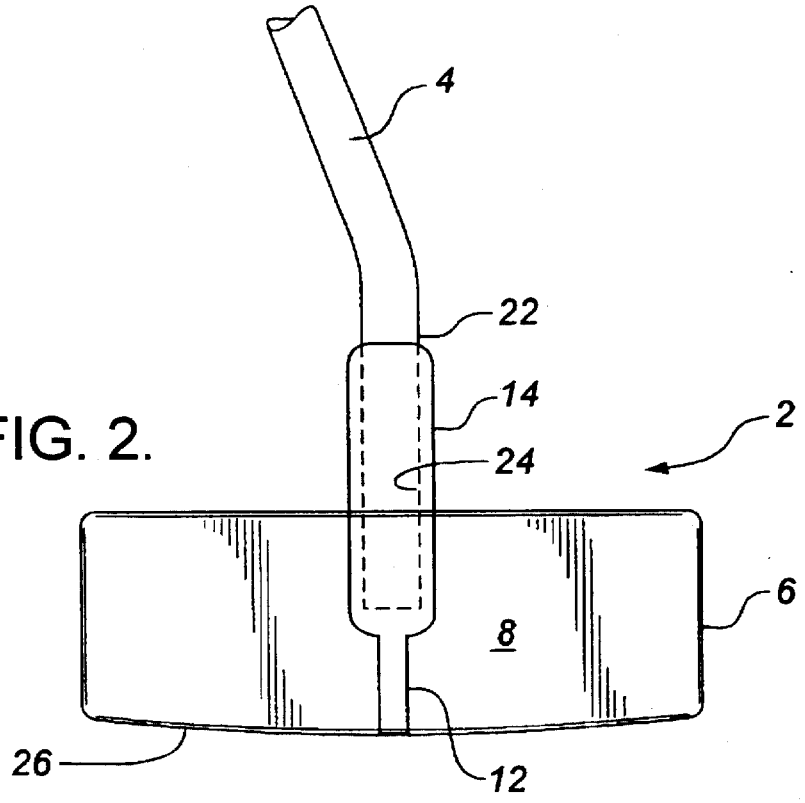
FIG. 2 is a sectional view of the one embodiment of the putter having a straight shaft with the lower portion inserted perpendicularly about its base taken along line 2—2 of FIG. 1.
Figure 3:
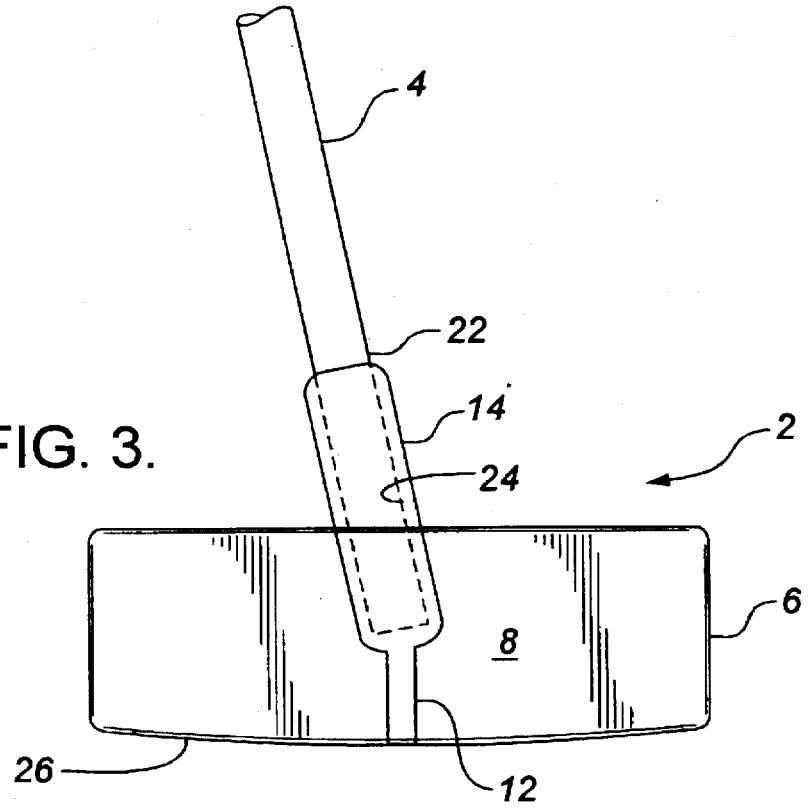
FIG. 3 is a sectional view of a second embodiment of the putter but having the shaft angled about its lower portion similar to FIG. 2.
Figure 4:
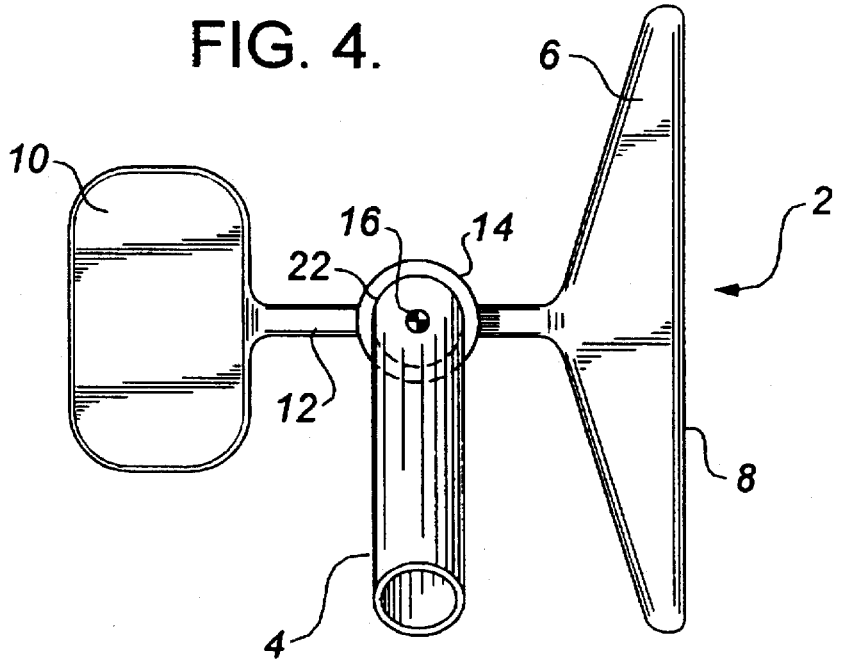
FIG. 4 is a plan view of the putter of FIG. 2.
Figure 5:
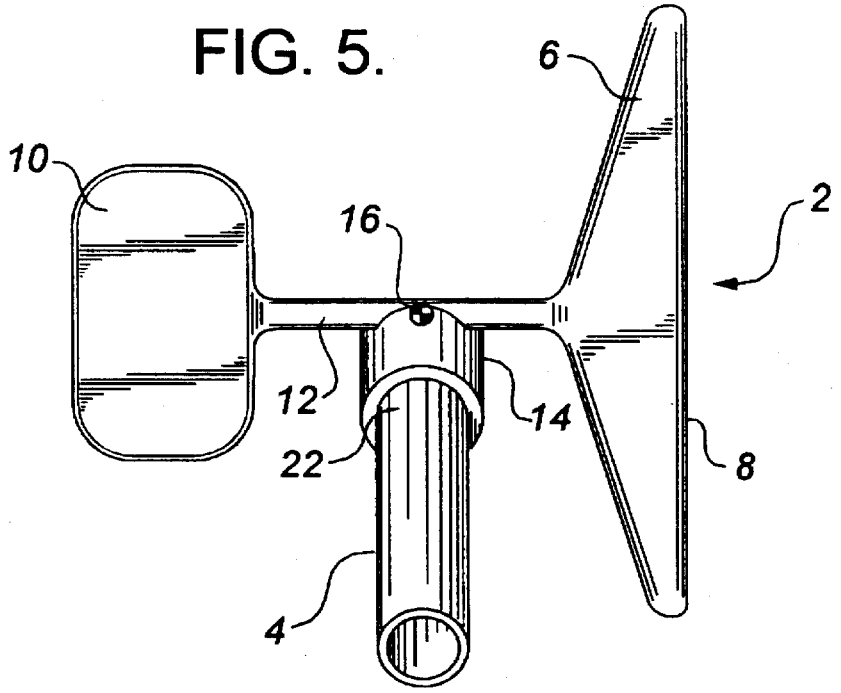
FIG. 5 is a plan view of the putter of FIG. 3.
Figure 6:
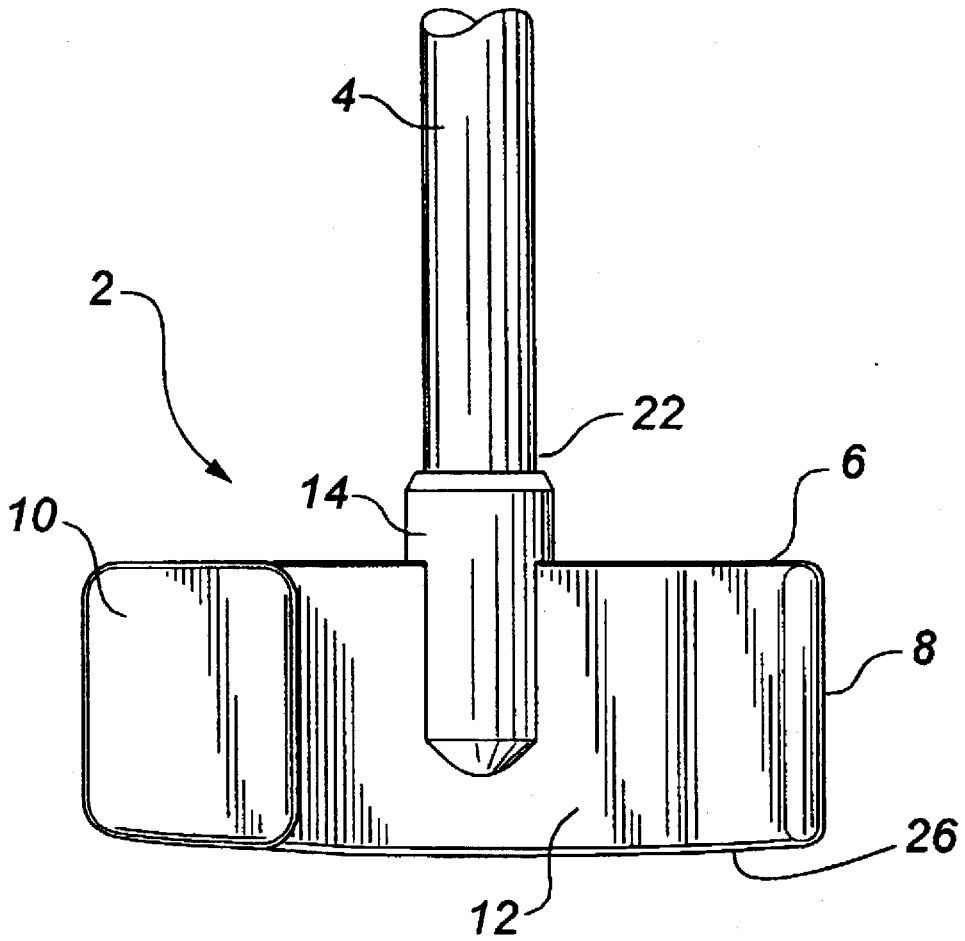
FIG. 6 is a side view of the putter head and lower shaft portion.

First and second embodiments of the shaft 4 placement is illustrated in FIGS. 2 and 4 and 3 and 5 respectively. The base portion of the shaft 22 fits into the bore 24 of hosel 14 which is adapted to be secured into a section of the web 12. A suitable member 16 secures the hosel 14 to the web 12.

The base edge 26 of the striking face 8 is gently curved about both its vertical and horizontal planes.

The embodiments in which an exclusive property or privilege are claimed are defined by the claims which now follow:

1. A golf putter counterbalanced about the base of the putter shaft which comprises:

a putter head, said putter head having a forward striking section with a striking surface thereon and a counterbalancing rearward section at the rear thereof, said forward and rearward sections being interconnected by a web to thereby form an integral putter head wherein said web is joined to said striking section at an apex of said striking section;

an elongate shaft mounted in association with said web at substantially the centre of gravity of said putter head;

a lower edge of said striking section being curved in both vertical and horizontal planes when said putter is in a use position; and said forward striking section having a triangular cross section and said rearward counterbalancing section being generally rectangular in cross section.

2. The golf putter defined in claim 1 wherein said web has a height that is essentially equal to the height of said striking section and said counterbalancing section.

3. The golf putter defined in claim 2 further including a hosel in said web.

4. The golf putter defined in claim 2 wherein the thickness of said web is less than the thickness of said counterbalancing section.

5. The golf putter defined in claim 4 wherein the thickness of said web is less than the thickness of said striking surface.

6. The golf putter defined in claim 1 wherein said putter head is one piece.

* * * * *